US008991341B2

(12) United States Patent
Le Forestier

(10) Patent No.: US 8,991,341 B2
(45) Date of Patent: Mar. 31, 2015

(54) VALVE ACTUATION MECHANISM AND AUTOMOTIVE VEHICLE COMPRISING SUCH A VALVE ACTUATION MECHANISM

(75) Inventor: Romain Le Forestier, Reyrieux (FR)

(73) Assignee: Renault Trucks, St. Priest (FR)

( * ) Notice: Subject to any disclaimer, the term of this patent is extended or adjusted under 35 U.S.C. 154(b) by 0 days.

(21) Appl. No.: 14/127,276

(22) PCT Filed: Jul. 22, 2011

(86) PCT No.: PCT/IB2011/002487

§ 371 (c)(1),
(2), (4) Date: Dec. 18, 2013

(87) PCT Pub. No.: WO2013/014491

PCT Pub. Date: Jan. 31, 2013

(65) Prior Publication Data

US 2014/0182533 A1 Jul. 3, 2014

(51) Int. Cl.

| | |
|---|---|
| ***F01L 1/34*** | (2006.01) |
| ***F01L 1/18*** | (2006.01) |
| ***F01L 13/00*** | (2006.01) |
| ***F01L 13/06*** | (2006.01) |
| ***F01L 13/08*** | (2006.01) |

(52) U.S. Cl.

CPC . *F01L 1/34* (2013.01); *F01L 1/181* (2013.01); *F01L 13/0021* (2013.01); *F01L 13/06* (2013.01); *F01L 13/08* (2013.01)

USPC ..... 123/90.16

(58) Field of Classification Search

CPC ..... F01L 1/34; F01L 13/0021; F01L 13/06; F01L 13/08

USPC ..... 123/90.12, 90.16, 90.39

See application file for complete search history.

(56) References Cited

U.S. PATENT DOCUMENTS

| | | | |
|---|---|---|---|
| 6,253,730 | B1 | 7/2001 | Gustafson |
| 6,422,186 | B1 | 7/2002 | Vanderpoel |
| 2003/0024501 | A1 | 2/2003 | McCarthy et al. |
| 2010/0307451 | A1 | 12/2010 | Lee et al. |

FOREIGN PATENT DOCUMENTS

| | | | |
|---|---|---|---|
| WO | 9009514 | A1 | 8/1990 |
| WO | 9108381 | A1 | 6/1991 |
| WO | 02101212 | A2 | 12/2002 |
| WO | 2005089724 | A2 | 9/2005 |

OTHER PUBLICATIONS

International Search Report (Mar. 21, 2012) for corresponding Intentational application No. PCT/IB2011/002487.

*Primary Examiner* — Zelalem Eshete
(74) *Attorney, Agent, or Firm* — WRB-IP LLP

(57) ABSTRACT

A valve actuation mechanism for an internal combustion engine includes rockers moved by a camshaft, each rocker being adapted to exert a valve opening force on at least a portion of a opening actuator of each cylinder, via an activation piston of the rocker movable with respect to the rocker under action of a fluid pressure raise in a chamber, from a first position to a second position, in which a cam follower of the rocker is adapted to read at least one auxiliary valve lift sector of a cam of the camshaft so as to perform an engine operating function. Each rocker includes a valve for releasing fluid from the chamber, wherein the valve actuation mechanism includes, for each rocker, a stopper fast with a housing of the engine and adapted to exert, on a member of the rocker, a variable force for opening the fluid releasing valve.

20 Claims, 10 Drawing Sheets

VALVE ACTUATION MECHANISM AND AUTOMOTIVE VEHICLE COMPRISING SUCH A VALVE ACTUATION MECHANISM

BACKGROUND AND SUMMARY

The invention concerns a valve actuation mechanism for an internal combustion engine on an automotive vehicle. The invention also concerns an automotive vehicle, such as a truck, equipped with such a valve actuation mechanism.

Automotive vehicles, such as trucks, often rely on an engine brake function to slow down in order, for example, to reduce wear of the friction brake pads and to prevent overheating of the friction brakes, particularly on downward slopes. It is known to perform engine brake by acting on the amount of gas present in the cylinders of the engine in two distinct phases. In a first phase, when the pistons are near a bottom dead center, one injects exhaust gases into the chambers of the cylinders so as to slow down the pistons when they move towards their high level. This is done by slightly opening at least a valve connected to an exhaust manifold, while exhaust gases are prevented to be expelled from the exhaust pipe and thereby at a certain pressure above atmospheric pressure. In the second phase, the gases which are compressed the piston are expelled from the chamber of the cylinder when the piston is at or near its top dead center position in order to prevent an acceleration of the piston under effect of volcanic expansion of compressed gas, this is done by slightly opening a valve so as to expel gases from the cylinder. In most cases, the valve (or valves) which is (are) opened for the engine brake function is (are) a main exhaust valve. An engine brake system is described in document WO 9009514.

To perform these engine brake valves movements, also called engine brake valves lifts, the engine comprises, for each cylinder, a rocker acting, on the valves to open and close them. The rocker is acted upon by a rotating cam which has at least one lift sector to cause the lifting (opening) of the valve. If the valve is also an exhaust or an intake valve, the corresponding cam will comprise a main valve lift sector and one or several auxiliary valve lift sectors (also called main valve lift bum^^ When engine brake is needed, a cam follower surface of the rocker is moved in close contact with a cam of a camshaft moving the rocker so that the brake movements of the valve are obtained, when the cam follower interacts with the auxiliary valve lift sectors. In normal operating conditions of the engine, the valves should not perform these movements and the roller of the rocker is kept slightly remote from the cam so that the cam follower does not interact with the auxiliary valve lift sectors. The distance or clearance between the roller and the earn ensures that only the larger main lift sector on the cam, dedicated to the main exhaust event, causes an opening of the exhaust valve, but not one or several smaller auxiliary lift sectors dedicated to the engine brake function. This clearance is suppressed when engine brake is needed, by moving an activation piston of the rocker to make a close contact between the roller and the cam, so that engine brake dedicated lift sectors on the cam also cause an opening of the valve. An engine brake system having such valve actuation mechanism is described in WO-91/08381

In the case of a system where two valves are to be actuated, the piston can be in contact with the valves through a valve bridge.

When the engine brake valve opening(s) have been performed, a reset function is preferably to be performed. In other words, the activation piston needs to be moved towards its initial position in order to ensure that the valves are closed early enough in order to prevent extended valve lift overlap.

Engine brake systems generally comprise a control valve to direct pressurized control fluid pressure in a chamber adjacent to the piston to move the activation piston from its initial position to its engine brake actuation position. The control valve controls whether or not the engine brake function is activated. This control valve lets pressurized, control fluid flow, at a pressure of for example 2 to 5 bars, towards each rocker as long as the engine brake function is needed, which typically lasts several seconds or tens of seconds during which the engine and the cam shaft may perform several hundreds or thousands of complete revolutions. In some systems, a check valve is provided to prevent any fluid flow out of the chamber. In some known systems, such as the one described in WO-91/08381, the check valve can nevertheless be forced to an open position, allowing the control fluid to escape the chamber when the engine brake is not needed. This is achieved when no control pressure is sent to the control valve. In known systems, there is only one control valve for several cylinders, so that it is not possible to use the control valve to empty the chamber to allow retraction of the piston, if such retraction is needed for a period of time inferior to one revolution of the camshaft.

It is known, for example from U.S. Pat. No. 6,253,730, to act on the check valve thanks to a stopper which is fixed to a housing, of the engine, so as to open the check valve and release fluid pressure in the chamber so that the piston may move towards its initial position, retracted. This technical solution is not applicable in the case of a so-called "single valve engine braking" where the additional valve lift opening are performed with only one of two exhaust vales is opened for performing engine braking. Indeed, the stopper has to be positioned with respect to the rocker so that it forces the check valve to an open position for a valve lift value superior to the additional valve lift value, but allows the check valve to close again at the same valve lift value when the valves are closing, allowing the actuation piston to be extended again, which delays the valve closing.

The aim of the invention is to provide a valve actuation mechanism in which the fluid pressure in the piston chamber can be reduced with satisfying time accuracy and relatively low forces.

To this end, the invention concerns a valve actuation mechanism for an internal combustion engine on an automotive vehicle, comprising rockers moved by a camshaft, each rocker being adapted to exert a valve opening force on at least a portion of a opening actuator of each cylinder, via an activation piston of the rocker movable with respect to the rocker under action of a fluid pressure raise in a chamber, from a first position to a second position, in which a cam follower of the rocker is adapted to read at least one auxiliary valve lift sector of a cam of the camshaft so as to perform an engine operating function, each rocker comprising a valve for releasing fluid from the chamber, wherein the valve actuation mechanism comprises, for each rocker, a stopper fast with a housing of the engine and adapted to exert, on a member of the rocker, a variable force for opening, the fluid releasing valve.

According to further aspects of the invention which are advantageous but not compulsory, such a valve actuation mechanism may incorporate one or several of the following features:

- the variable force increases when the rocker rotates from a valve closing position to its valve opening position;
- the stopper causes opening of the fluid releasing valve for a first position of the rocker and allows closing of the fluid releasing valve for a second position of the rocker, said second position being closer to the valve closing position of the rocker than said first position;

the stopper comprises elastic means which are stressed when the rocker travels from its valve closing position to its valve opening position;

the stopper comprises a spring adapted, when deformed, to exert a compression force on said member;

the stopper comprises a mobile contact element biased by the spring and adapted to cooperate with said member, the contact element and the spring are movable in translation with respect to a jacket in which the contact element and the main spring are housed, said jacket being fast with said engine housing.

the jacket comprises a stop element against which the contact element comes in abutment when the piston has to be moved from its second position to its first position;

the elastic means of the stopper have a variable stiffness;

the stopper comprises a main spring and an auxiliary spring, wherein, during a first portion of the rocker travel from a valve closing to a valve opining position, only the auxiliary spring is stressed, and wherein during a second portion of the rocker travel, the main spring is stressed;

the stopper is in permanent contact with the member of the rocker on which the force of the stopper is exerted;

prior to the exertion of the force of the stopper on the member of the rocker, the stopper is remote from the member by a clearance;

the force exerted by the stopper on said member is adapted to overcome a force keeping said valve in a closed position only when the piston has to be moved from its second position to its first position;

for each rocker, the member on which the force of the stopper is exerted cooperates with a check valve adapted to allow fluid flow from a fluid feeding, circuit of the rocker to the chamber or to block fluid flow from the chamber to the fluid feeding circuit, said check valve forming the valve for releasing fluid from the chamber.

for each rocker, the member on which the force of the stopper is exerted cooperates with a reset valve, movable with respect to the rocker, between a first position, in which it blocks fluid flow between the chamber and the outside of the rocker, and a second position, in which it allows fluid flow between the chamber and the outside of the rocker, said reset valve forming the valve for releasing fluid from the chamber;

the fluid releasing valve is adapted to allow fluid flow from the chamber to the outside of the rocker, wherein the piston) comprises:

a first element housed in the bore and movable in translation with respect to the rocker, and a central member housed in a portion of the first element and movable in translation with respect to the first element along a longitudinal axis of the piston, wherein the fluid releasing valve is formed by a cooperation between the first element and the central member, and wherein the force of the stopper is exerted on the first element.

the valve for releasing fluid from the chamber is kept in its closed position by a fluid pressure force in a chamber fluidly connected to the piston chamber;

each rocker comprises a normally closed discharge valve which is opened by the fluid pressure in the chamber when such pressure exceeds a predetermined threshold to allow fluid flow out of the chamber, said discharge valve forming the valve for releasing fluid from the chamber, and wherein the member on which the force of the stopper is exerted is the piston;

the discharge valve is carried by the piston;

the valve for reducing fluid pressure in the chamber is biased towards its closed position by a spring;

the valve actuation mechanism is one of:

an exhaust valve actuation mechanism:

wherein the activation piston (95) activates an exhaust gases recirculation function when it is in its second position; or wherein the activation piston (95) activates an engine brake function when it is in its second position; or an intake valve actuation mechanism.

The invention also concerns an automotive vehicle, such as a truck, comprising a valve actuation mechanism as mentioned here-above.

BRIEF DESCRIPTION OF THE DRAWINGS

The invention will now be explained in correspondence with the annexed figures, as an illustrative example. In the annexed figures.

DETAILED DESCRIPTION

Figure 1:
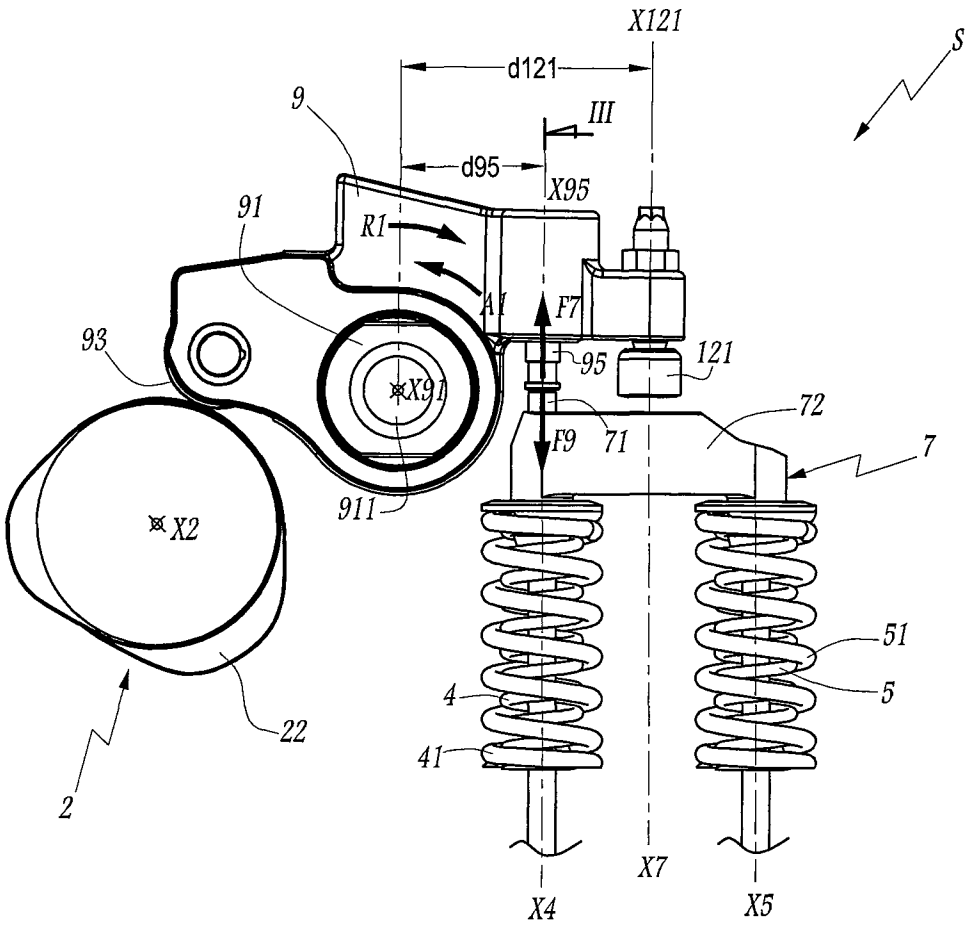
FIG. 1 is a side view of a valve actuation according to a first embodiment of the invention.

The valve actuation mechanism S of the invention, represented on FIGS. 1 to 4, comprises a camshaft 2 rotatable around a longitudinal axis X2. Camshaft 2 comprises several cams 22, each being dedicated to moving the valves of one cylinder of an internal combustion engine E, of a non represented automotive vehicle, such as a truck, on which valve actuation mechanism S is integrated. Each cam has a earn profile which may comprise one or several "bumps", i.e. valve lift sectors where the cam profile exhibits a bigger eccentricity with respect to axis X2 than the base radius of the cam. FIG. 1 shows a portion of valve actuation mechanism S corresponding to one cylinder of the engine.

In this embodiment, each cylinder of engine E, is equipped with two exhaust valves 4 and 5. Valves 4 and 5 are biased towards their dosed position by respective springs 41 and 51. Each valve 4 and 5 is movable in translation along an opening axis X4 or X5 so as to be opened, or lifted. More precisely, translation of valves 4 and 5 opens a passageway between the combustion chamber of the cylinder and an exhaust manifold. Valves 4 and 5 are connected to a valve bridge 7, which forms a valve opening actuator, and which extends substantially perpendicular to axes X4 and X5. In this embodiment, only one valve 4 is opened to perform the engine brake function.

This technology called "single valve engine brake" permits to reduce forces excited on the valves, in order to improve the reliability of valve actuation mechanism S. The valve bridge 7 comprises a main portion 72, which causes opening of valve 5. Valve bridge 7 also comprises a slider block 71 which is movable with respect to main portion 72 of valve bridge 7 along opening axis X4 of valve 4. Slider block 71 is connected to valve 4 so as to be able to cause its opening. Consequently, valve 4 is also movable with respect to main portion 72 of valve bridge 7 along axis X4.

Valves 4 and 5 are partly represented on the figures, only their respective stems are visible.

For each cylinder, the transmission of movement between camshaft 2 and valve bridge 7 is performed by a rocker 9 rotatable with respect to a rocker shaft 91 defining a rocker rotation axis X91. Only one rocker 9 is represented on the figures. Each rocker 9 comprises a roller 93 which acts as a cam follower and cooperates with a cam 22. Roller 93 is located on one side of rocker 9 which respect to shaft 91. Each rocker 9 comprises, opposite to roller 93 with respect to shaft 91, an activation piston 95 adapted to exert a valve opening force F9 on the slider block 71 of valve bridge 7, which is connected to valve 4, for example merely by being in contact with the valve stem.

Rocker 9 further comprises a finger 121 substantially parallel to piston 95, and centered on an axis X121. d95 denotes the distance between axes X91 and X95. d121 denotes the distance between axes X91 and X121. Distance d121 is larger than distance d95. Piston 95 is arranged in rocker 9 so that it cooperates with slider block 71, while finger 121 is adapted to cooperate with the main portion 72 of valve bridge 7. It can be noted that the plane defined by the axes X4, X5 of the valves is perpendicular to the rotation axis X91 of the rocker 9. Valve 5 is further away from the rocker rotation axis than valve 4.

Rotation of camshaft 2 transmits, when the roller runs against a valve lift sector of the cam, a rotation movement R1 to rocker 9 via roller 93, this rotation movement inducing a translation movement of main portion 72 of valve bridge 7 and of slider block 71, respectively due to finger 121 and to activation piston 95, along an axis X7 which is parallel to axes X4 and X5. Cooperation between a main valve lift sector of cam 22 and roller 93, on the one hand, and between piston 95 and slider block 71 and between finger 121 and main portion 72 of valve bridge 7, on the other hand, generates exhaust openings of valves 4 and 5 during the corresponding operating phase of internal combustion engine E. The rocker has an alternate rotation movement and can therefore rotate between a valve closing position, and a valve opening position, depending on the cam profile.

In the shown embodiment, rocker shaft 91 is hollow and defines a duct 911 which houses fluid circuit coming from a non-shown fluid tank of valve actuation mechanism S. Rocker 9 comprises itself an internal fluid circuit which connects duct 911 to a piston chamber 101 of rocker 9, partly delimited by piston 95, via a check valve 97. Activation piston 95 is housed in a bore 94 of rocker 9 and adapted to move with respect to chamber 101 along a translation axis X95 corresponding, to a longitudinal axis of piston 95. A duct U 27 partly-shown on FIG. 2, connects duct 911 to check valve 97. A duct 913 fluidly connects check valve 97 to piston chamber 101.

When the engine switches to engine brake mode, a non shown engine brake control valve delivers pressurized fluid to ducts 911 and 912, which entails that pressurized fluid flows though check valve 97 in piston chamber 101. The pressure raise in chamber 101 induces a translation movement of piston 95 outwardly with respect to rocker 9, from a first position, in which piston 95 is entirely or partially pushed back into chamber 101 to a second position, in which piston 95 is partially moved out of piston chamber 101 until it comes in abutment against slider block 71. Preferably, the control fluid is a substantially incompressible fluid such as oil.

Cam 22 comprises in this embodiment two auxiliary valve lift sectors which are adapted to cooperate with roller 93. These sectors induce, when read by roller 93 of rocker 9, two additional pivoting movements of rocker 9 on each turn of camshaft 2. The auxiliary lift sectors are usually designed to cause only a limited lift of the valve, as they are not intended to allow a great flow of gases through the valve. Typically, the lift caused by the auxiliary valve lift sectors is less than 30 percent of the maximum valve lift value. These pivoting movements are transformed by piston 95 into two opening movements of valve 4 so as to perform an engine brake function at two precise moments during operation of engine E as described briefly above. The purpose and effects of these valve openings are well-known and will not be further described hereafter. According to an alternate embodiment, cam 22 comprises only one auxiliary valve lift sector fix performing only one opening of valve 4 on each turn of camshaft 2, in addition to the main exhaust valve opening.

Figure 2:
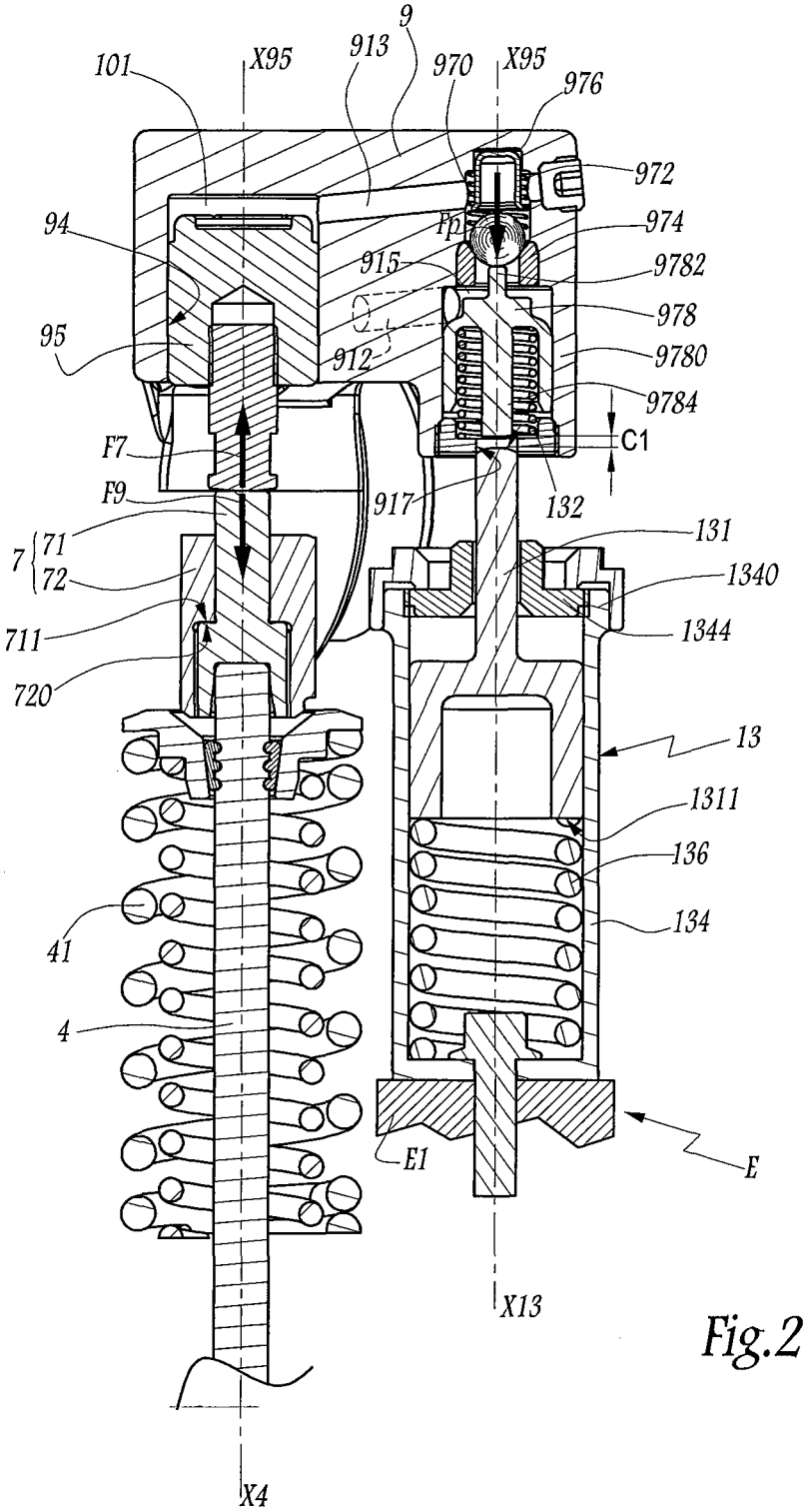
FIG. 2 is a sectional view, along plane II on FIG. 1, of a portion of the valve actuation mechanism of FIG. 1, in a first configuration.

When piston 95 is in its first position, retracted, as shown on FIG. 2, roller 93 is offset with respect to the auxiliary valve lift sectors of cam 22 by an engine brake actuation clearance, so that when camshaft 2 rotates around axis X2, cam 22 does not come in contact with roller 93, or piston 95 does not come in contact with slider block 71. The clearance is such that the auxiliary valve lift sectors cannot cause the opening of valve 4, because the rotation of the rocker induced by the auxiliary valve lift sectors is too limited to compensate for the clearance. To the contrary, a main valve lift sector causes a displacement of the rocker 9 around its axis which is sufficient to cause opening of both valves.

Figure 4:
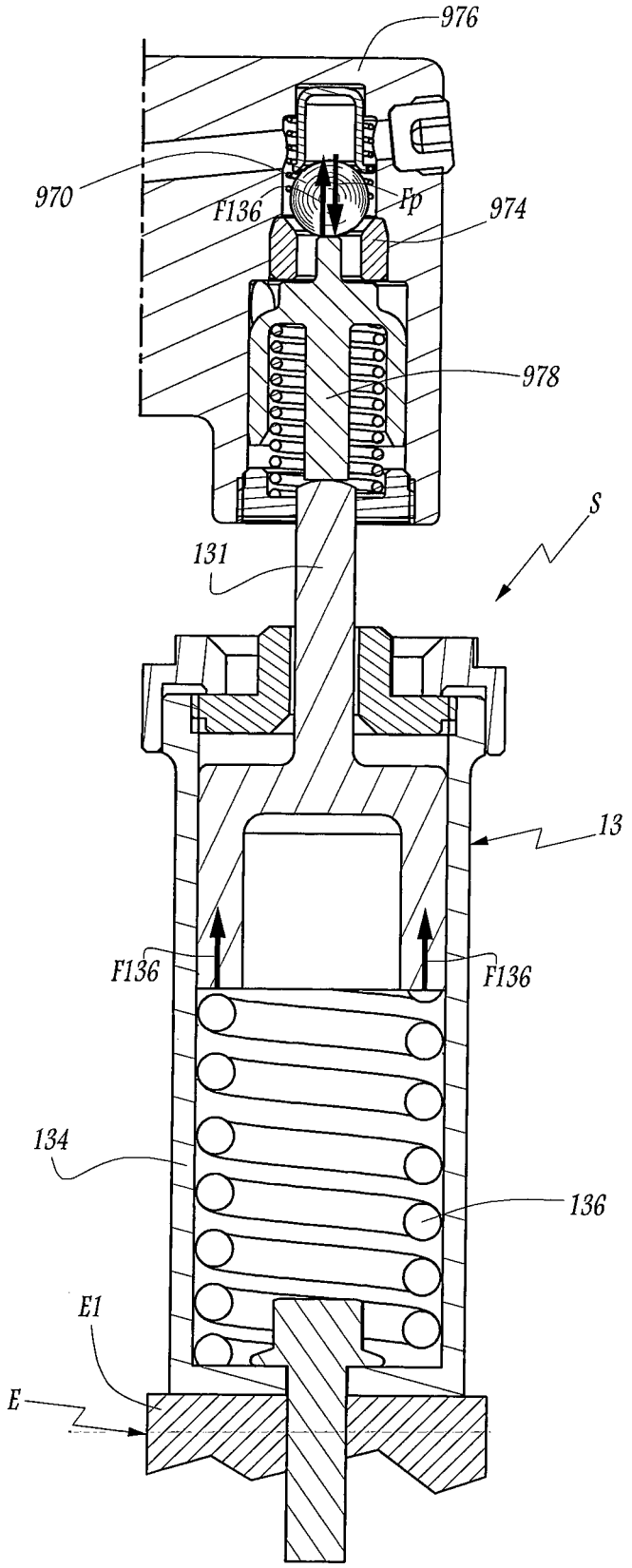

By moving piston 95 to its second position, extended, as shown on FIG. 4, rocker pivots around the longitudinal axis X91 of shaft 91. Thus, the actuation clearance is suppressed and roller 93 comes into contact with the auxiliary valve lift sectors of cam 22, while the activation piston s simultaneously in contact or quasi contact with the slider block 71, allowing engine brake operations to be implemented when the roller 93 is acted upon by any one of the auxiliary valve lifts.

Normal exhaust openings of valves 4 and 5 during engine brake operations are implemented as follows. Piston 95 is first moved towards its second position, so that, when a rotation of rocker 9 along arrow R1 starts, the system causes the opening, of only valve 4 when the cam follower reads the additional valve lift sectors. Those sectors do not cause opening of valve 5. When the auxiliary valve lift sectors have been read by roller 93, roller 93 begins to read a main valve lift sector 220, inducing a rotation of rocker 9 sufficient to generate a contact between finger 121 and main portion 72. From this moment on, the main portion 72 of valve bridge 7 is moved and opening of valve 5 begins, in parallel to the movement of valve 4.

At a further rotation angle of rocker 9, because piston 95 abuts against a non-shown stop of bore 94 which limits its motion outside rocker 9, contact is lost between piston 95 and slider block 71. From this moment on, main portion 72 cooperates with slider block 71 thanks to a stop 720 which cooperates with a shoulder 711 of slider block 71. Slider block 71, and also valve 4, become integral in translational movement with main portion 72, until the opening of valves 4 and 5 is complete.

When valves 4 and 5 return to their closed position, movement of bridge 7 is performed exactly in the opposite manner compared to the opening movement until contact is made again between piston 95 and slider block 71. An elastic force is therefore exerted on piston 95 by spring 41 via slider block 71, provoking a pressure raise in chamber 101, which is closed at this moment. The fluid in chamber 101 blocks the motion of piston 95 towards its first position. Therefore, absent the invention, the valve 4 would close later than valve 5. This would provoke extended valve overlapping, which reduces the efficiency of the engine brake function.

According to a variant of the invention, piston 95 may be adapted to activate or deactivate an internal, exhaust gases recirculation function. This function allows an exhaust valve opening during the intake stroke. By returning a controlled amount of exhaust gas to the combustion process, peak combustion temperatures are lowered. This will reduce the formation of Nitrogen oxides (NOx).

According to a non-shown embodiment of the invention, valve actuation mechanism S may be an intake valve actuation mechanism for moving two intake valves adapted to open passageway between the combustion chamber of the cylinder and an intake manifold. In this case, the activation piston may be adapted to activate or deactivate an intake function based on early or late Miller cycle (Atkinson) which are well known and not further described hereafter.

In the first embodiment of the invention represented on FIGS. 1 to 4, check valve 97 comprises a ball 970 which is kept, by a compression spring 972, against a seat 974. Bali 970, spring 972 and seat 974 are arranged in a check valve chamber 976 realized in rocker 9. Chamber 976 has a cylindrical form centered around a longitudinal axis X97. Chamber 976 is fluidly connected to piston chamber 101 via duct 913. Ball 970 is movable along axis X97 with respect to seat element 974. Fluid pressure in the chamber 976, and thus in chamber 101 tends to push the ball 970, which acts as a plug member for the valve, on the valve seat 974, thereby closing the valve.

Duct 911 of rocker shaft 91 is connected, via duct 912, to a first chamber 915 realized in rocker 9. First chamber 915 is connected to check valve chamber 976 through seat 974. First chamber 915 is opposite the check valve chamber 976 with respect to the seat, so that fluid pressure in the first chamber 915 tends to push the ball away from the seat, thereby opening the check valve. A check valve actuation member 978 is housed in chamber 915, also for forcing the opening of the valve. Actuation member 978 is movable with respect to chamber 915, which has a cylindrical form, along axis X97. Actuation member 978 comprises an outer sleeve 9780. Actuation member 978 further comprises a pushing pin extending along axis X97 and adapted to make a contact with ball 970. A further spring is provided to act on the actuation member 978 so as to push it in the direction in which it forces the ball 970 off the seat 974, thereby forcing the opening of the check valve. When thud pressure is delivered to chamber 915 though duct 912, which is controlled by the non shown engine brake control valve, the actuation member is pushed against the action of the spring, so as not to interfere anymore with the ball 970, which can therefore open and close as a normal check valve, essentially based on the pressure differential on both sides of the valve. Actuation member 978 also comprises a central pin 9784 extending along axis X97 opposite to pushing pin 9782. Central pin 9784 extends in the vicinity of an end of chamber 915 which opens by a hole 917, on the outside of rocker 9.

According to the invention, a stopper 13 is provided which is fast with a housing of the engine F and adapted to exert, on a member of the rocker 9, a variable force for opening the fluid releasing valve.

Preferably, the force exerted by the stopper 13 on said member is adapted to overcome a force keeping said valve in a closed position only when the piston 95 has to be moved from its second position to its first position.

Preferably, the variable force exerted by the stopper 13 increases when the rocker rotates from a valve closing position to its valve opening position.

In this embodiment, the stopper 3 is an elastic, stopper and the element of the stopper with which the ^ stop ^ valve 97, the check valve being the valve which performs the function of releasing fluid from the chamber 101. Therefore, an elastic stopper 13 is adapted to cooperate, via actuation member 978, with check valve 97. Stopper 13 comprises a contact element, here in the form of a pushrod 131 extending along a longitudinal axis X13 and having a pushing end 132. Pushing end 132 is adapted to cooperate with central pin 9784, through hole 917. Stopper 13 is hidden on FIG. 1 for the simplicity of the drawing.

Stopper 13 comprises a cylindrical housing jacket 134 which has an open upper end 1340 and a lower end 1342 which is fast with a housing E1 of the engine E. Pushrod 131 is mounted in jacket 134 and is adapted to move translationally with respect to jacket 134 along axis X13.

In the vicinity of open end 1340, jacket 134 comprises a stopper element 1344 which limits the translation of pushrod 131 along axis X13 towards rocker 9. Pushrod 131 also comprises a peripheral collar 1311. A main compression spring 136 is mounted between peripheral collar 1311 and end 1342 so as to urge pushrod 131 against, stopper element 1344.

In this embodiment, valve actuation mechanism S operates in the following way during an engine brake operation: prior to the rotation of rocker 9 from a valve closing position towards a valve opening position in the direction of arrow R1, a clearance C1 separates central pin 9784 from pushing end 132 of pushrod 131, as shown on FIG. 2 or may be instead provided between actuation member 978 and bail 974. In other words, in this embodiment, the clearance C1 entails that, in the valve closing position of the rocker, the stopper does not exert a force on the fluid releasing valve, it can be noted that a control pressure is present in chamber 915 so that actuation member 978 does not interfere with ball 970. When rotation of rocker 9 begins, due to the cam follower 93 cooperating with a main valve lift sector of the cam 22, a contact is made between central pin 9784 and pushrod 131 as shown on FIG. 3. At this time, piston 95 has been moved to its second position and check valve 97 is closed due to the action of its bias spring 972 and of the pressure inside chamber 976, both acting, on the hall 970. Piston 95 is thereby prevented from going back into its first position under the action of a force F7 exerted by valve bridge 7 and induced by springs 41 and 51.

According to a non-shown variant, the clearance between central pin 9784 and pushing end 132 prior to the rotation of rocker 9 may be inexistent. Spring 136 may be designed to keep a permanent contact between central pin 9784 and pushing end 132.

Figure 3:
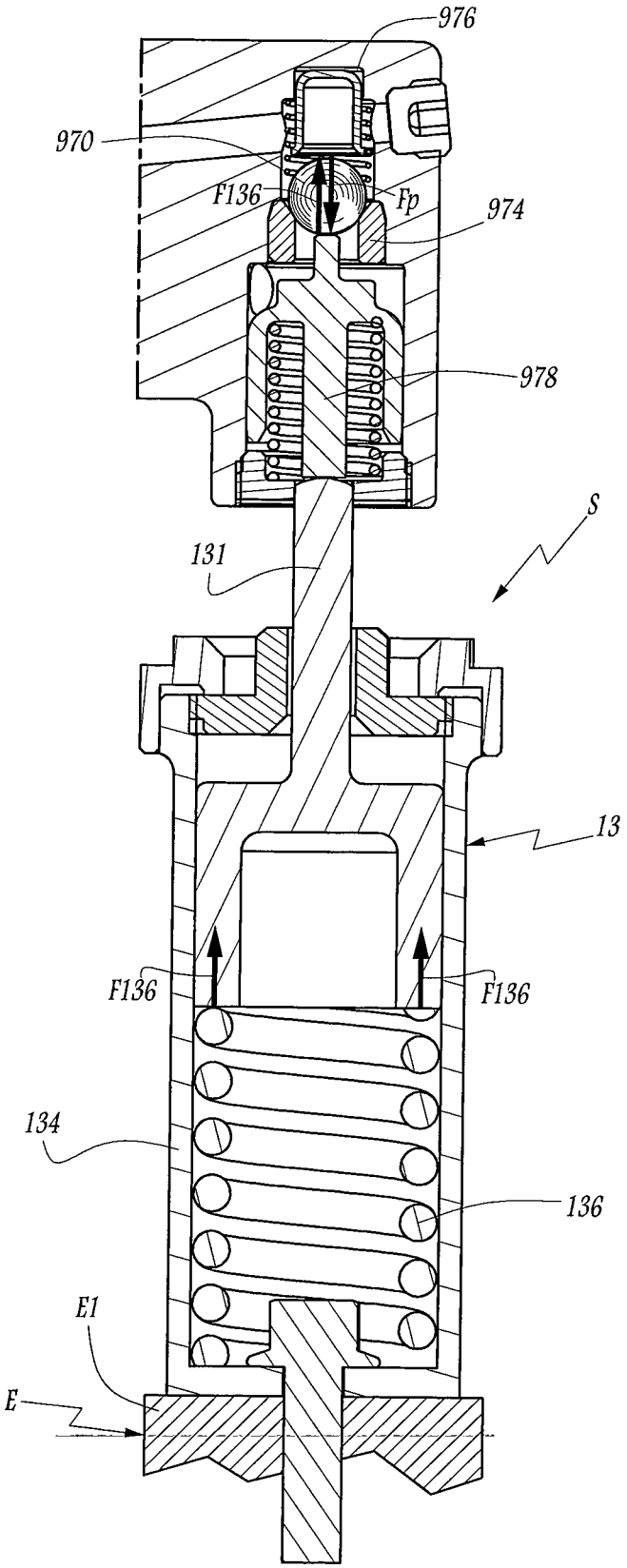
FIGS. 3 and 4 are sectional views corresponding to the right part of FIG. 2, for a second and third configuration

In the configuration of FIGS. 2 and 3, fluid pressure in chamber 976 exerts a force Fp on ball 970, which urges ball 970 against seat element 974. The contact between central pin 9784 and pushrod 131 induces a translation of pushrod 131 towards end 1342 and a subsequent deformation of main spring 136. In this configuration, as the deformation of main spring 136 is relatively low, the compression force F136 exerted by main spring 136 on pushrod 131 remains inferior to fluid pressure force Fp. The fluid pressure force Fp depends essentially on the force which is acting on activation piston 95, i.e. the force of the return spring 41 of valve 4. The fluid pressure in chamber 101 and in chamber 976 can be in the order of 20 bars.

When the rotation of rocker 9 goes further, pushrod 131 reaches a position, along axis X13, which induces an increased deformation of main spring 136 and an increased compression force F136. At this time, corresponding to a third configuration represented on FIG. 4, force F136 exerted by main spring 136 becomes superior to fluid pressure Fp. Force F136, transmitted to ball 970 via actuation member 978, then lifts ball 970 away from seat element 974. Check valve 97 is opened and pressure in chamber 976 is therefore reduced because some fluid is released from the chamber through the check valve 97. The pressure in chamber 101 can eventually fall to the value of the engine brake control pressure delivered by ducts 911 and 912, which can for example be in the order of 3 bars. This allows piston 95 to be pushed back to its first position. This position of the pushrod can be associated to a corresponding position of the rocker 9 between its valve closing and opening position and to a corresponding timing within the opening/closing cycle of valves 4 and 5. At said position and timing, which can be called the fluid release triggering position, the piston is moved from its second position to its first position, because said moment is not blocked anymore by the pressure in chamber 101.

Preferably, check valve 97 is opened before contact, is made between piston 95 and slider block 71 so that the elastic force exerted by spring 41 on valve 4, and transmitted to slider block 71, overcomes the fluid pressure force Fp in piston chamber 101. This allows to push back piston 95 towards its first position and to ensure valves 4 and 5 are substantially synchronized at closure.

The stiffness of main compression spring 136 is determined to obtain a pushing back of piston 95 in its first position at the time when valves 4 and 5 reach a lift value superior to the engine brake lift value, preferably close to maximal lift value of the valves 4 and 5. Therefore the stiffness of main compression spring 136 is determined so that the deformation of main spring 136, for such lift value of the valves, i.e. for the corresponding position of the rocker, and hence for the corresponding position of the rocker 9, induces a compression force F136 superior to the fluid pressure force Fp in chamber 976.

During the rotation of rocker 9 in the opposite direction relative to rotation R1, the elastic means of stopper 9 induce an hysteresis effect on the opening/closing of the fluid releasing valve, which is here check valve 97. Indeed after the rocker 9 has passed, on its way back to its valve closing position, the fluid release triggering position, the elastic means still exert a force on the relevant member of the rocker, here on the check valve 97, and in this embodiment through pushrod 131 and actuation member 978. Thereby, the fluid releasing valve, here check valve 97, remains opened during most of the rotation of rocker 9 back to its initial position, as long as the force provided by the elastic means are sufficient to maintain the release valve open. This three tends to decrease as the rocker comes back to its valve closing position, but the force that would tend to close the fluid releasing valve is now limited. In the example of FIGS. 2 to 4, such force is essentially the force of spring 972 which pushes back the ball 970 towards the seat. In any case, it can be noted that the pressure in chamber 101 is then only the pressure delivered by ducts 911 and 912, for example 3 bars. Therefore, the closing of the fluid releasing valve is allowed by the stopper at a position of the rocker, which can be called the fluid release inhibiting position, which is closer to the valve closing position of the rocker than the above mentioned fluid release triggering position. In other words, the stopper causes opening of the fluid releasing valve for a first position of the rocker and allows closing of the fluid releasing valve for a second position of the rocker, said second position being closer to the valve closing position of the rocker than said first position.

For example, in a single valve technology exhaust brake system where the reference exhaust valve 5, would have a certain main lift value (the maximum displacement of the valve 5 when in its fully opened position compared to its fully closed position), the fluid releasing triggering position could be set between around 30% and 50% of the main lift value. The fluid releasing inhibiting position could be set at less then 10%, preferably less than 5% and ideally around 1 or 2 percent of the main lift value.

Because the fluid releasing valve is maintained in its open position, piston 95 cannot be moved towards its second position.

As previously noted, the check valve is constructed so that it is kept in its closed position by a fluid pressure force Fp in a chamber 976 fluidly connected to the piston chamber 101. In other words, when the check valve is closed and when a pressure is present in chamber 101, said pressure tends to maintain the reset valve in its closed position. Therefore, the variable force exerted by the stopper 13 needs to overcome the fluid pressure force to cause the opening of the check valve at the fluid release triggering position. To the contrary, such fluid pressure force does not exist, or to a limited extent when the rocker comes back to the valve closing position. Thereby the force which the variable force F136 needs to overcome to maintain the check valve in its open position is much smaller than the force it needs to overcome to cause the opening of the check valve. Thus, the closing of the fluid releasing valve is allowed of the rocker, which can be called the fluid release inhibiting position, which is closer to the valve closing position of the rocker than the above mentioned fluid release triggering position.

In the following embodiments, elements similar to the first embodiment have the same references and work in the same way.

Figure 5:
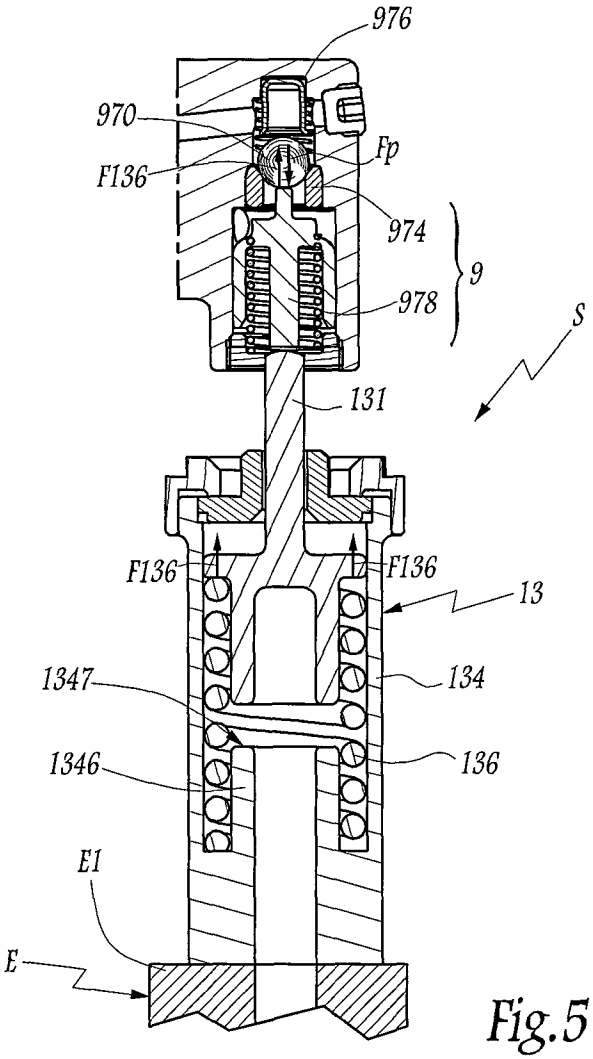

A second embodiment of the invention is represented on FIG. 5. In this embodiment, a jacket 134, of an elastic stopper 13 fast with a housing E1 of the engine E, comprises a central stopper sleeve 1346 which extends around axis X13 in the interior of main spring 136. Stopper sleeve 1346 comprises an abutment surface 1347 facing pushrod 131.

In this embodiment, pushrod 131 comprises, opposite to pushing end 132, an inner portion which defines an annular edge 1315, which faces surface 1347.

This embodiment operates in the following way: in a first phase, main spring 136 is deformed as in the first embodiment. Force F136 therefore increases at a progressive rate. At the time check valve 97 must be opened, annular edge 1315 of pushrod 131 comes into abutment with abutment surface 1347 of jacket 134. This induces the exertion of a large force on pushrod 131 and therefore on actuation member 978, inducing the opening of check valve 97. Piston 95 housed in a non-shown bore similar to bore 94, can then be moved back in its first position. The position of abutment surface 1347 along axis X13, with respect to jacket 134 is determined to correspond to the rotation angle reached by rocker 9 at the moment when check valve 97 must be opened; i.e. at the fluid release triggering position.

Figure 6:
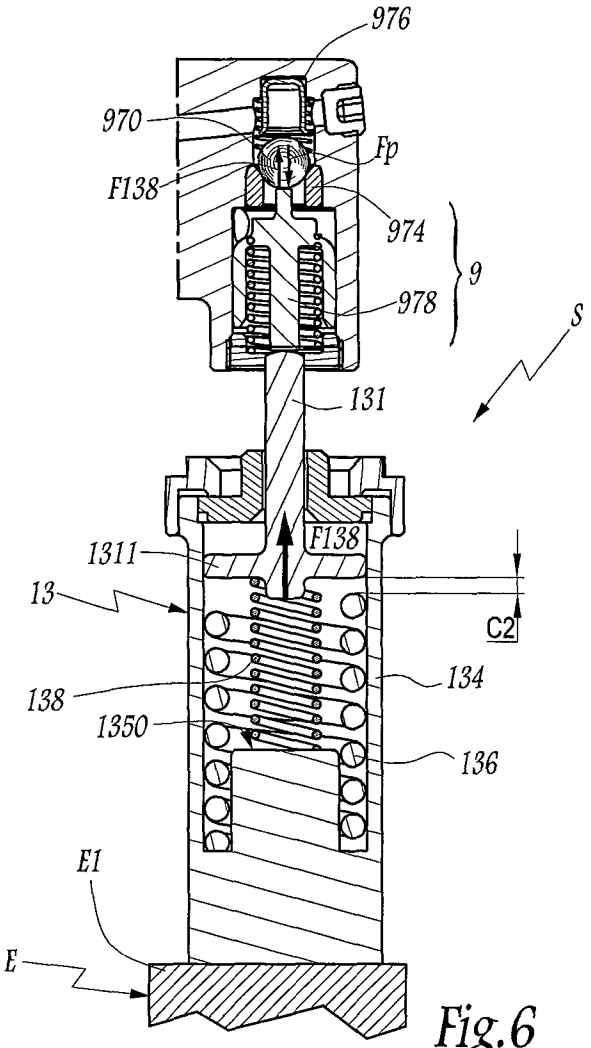
FIGS. 5 and 6 are sectional views similar to FIG. 2, of a valve actuation mechanism according to a second and a third embodiments of the invention.

A third embodiment of the invention is represented on FIG. 6. In this embodiment, an elastic stopper 13 fast with a housing E1 of engine E comprises an auxiliary spring 138, which extends along axis X13 radially in the interior of main compression spring 136. Auxiliary spring 138 extends from a base surface 1350 of jacket 134 and exerts a force F138 on pushrod 131.

This embodiment works in the following way: in the initial configuration of valve actuation mechanism S corresponding to FIG. 2. When the rocker is in a valve closing position, only auxiliary spring. 138 cooperates with pushrod 131, which is not in contact with actuation member 978. Main spring 136 is offset, along axis X13, by a clearance C2. When contact is made between pushing end 132 and actuation member 978, deformation of auxiliary spring 138 begins and lasts until peripheral edge 1311 of pushrod 131 makes a contact with main spring 136. The stiffness of auxiliary spring 38 is set to a value inferior to the stiffness value of main spring 136. This implies that when cooperation between main spring, 36 and pushrod 131 begins, a force similar to force. F136 is exerted on pushrod 131. The stiffness of main spring 136 is set to a value implying that said force is directly superior to force Fp, allowing check valve 97, which is housed in a non-shown bore similar to bore 94, to be driven back to its first position. Clearance C2 between main spring 136 and peripheral edge 1311 is set to a value allowing auxiliary spring 138 to be deformed until check valve 97 must be opened.

Figure 7:
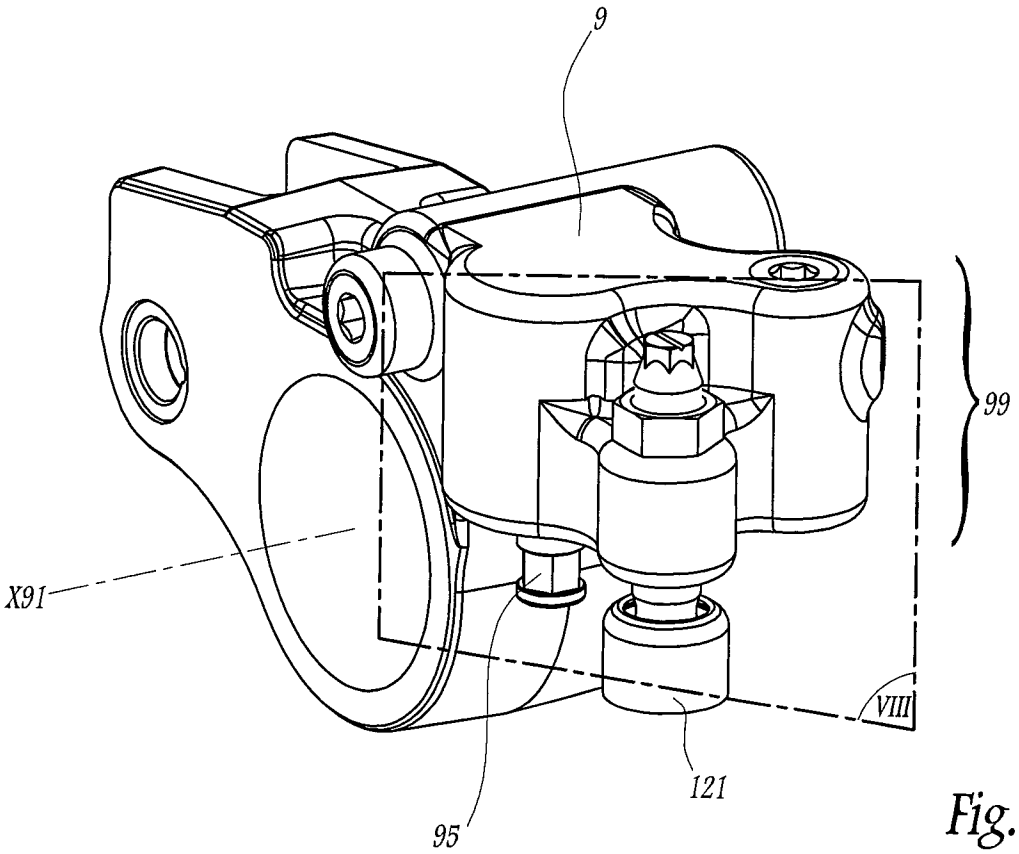
FIG. 7 is a perspective view of a rocker belonging to a valve actuation mechanism according to a fourth embodiment of the invention.
Figure 8:
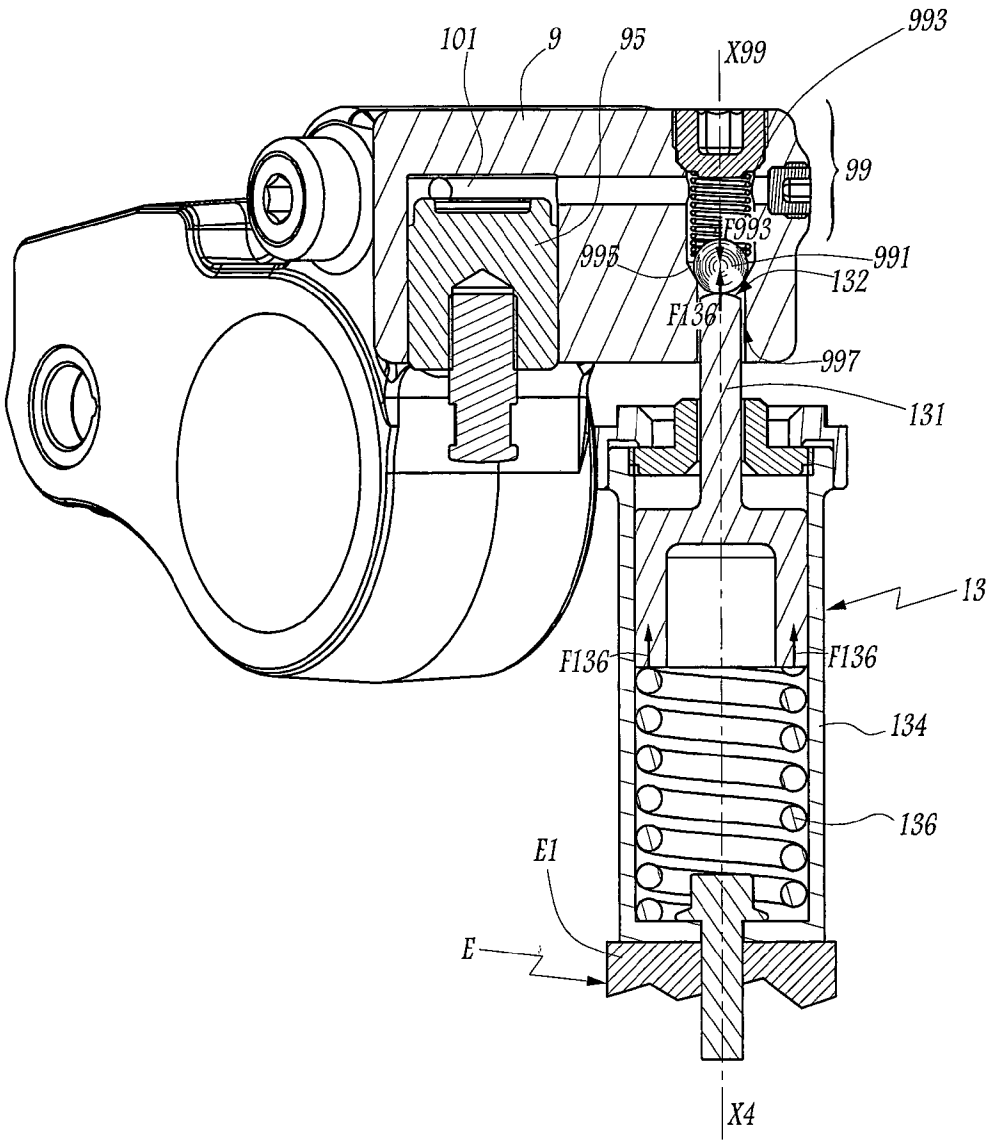
FIG. 8 is a sectional view along plane VIII on FIG. 7, of the valve actuation mechanism of FIG. 7.

A fourth embodiment of the invention is represented on FIGS. 7 and 8. In this embodiment, each rocker 9 comprises a reset valve 99 housed in a chamber 999 of rocker 9, fluidly connected to chamber 101 and adapted to reduce fluid pressure in chamber 101 by purging fluid via a non-shown discharge duct or to the outside of rocker 9. Reset valve 99 is biased towards its closed position, with a ball 991 of reset valve being biased against a seat 995, by a force F993 exerted by a compression spring 993 along a longitudinal axis X99 of reset valve 99. More predominantly, reset valve 99 is also kept in its closed position by a fluid pressure force Fp exerted by fluid in chamber 999. Said pressure reflects the pressure in chamber 10, and in most cases is equal to the pressure in chamber 101. In other words, when the reset valve is closed and when a pressure is present in chamber 101 said pressure tends to maintain the reset valve in its closed position. Reset valve is distinct from the check valve 97 as described in relation to the preceding embodiment, in that it is not provided between the chamber 101 and the control fluid source which can be formed by the ducts 911 and 912 of previous embodiments. Such check valve 97 may be present in this embodiment, although not described here.

A contact element, such as a pushrod 131, of an elastic stopper 13 fast with a housing E1 of the engine E, may exert, from outside of the rocker, a force F136 on the ball 911 to open the valve, by lifting the ball 991 from the seat 995, against, the action of the compression spring 993. When force F136 becomes superior to forces F993 and Fp, ball 991 is lifted away from seat 995, allowing fluid to flow outside rocker 9 through a hole 997 directly following seat 995 along the fluid stream direction. Piston 95 housed in bore 94 can then be moved back to its first position.

Therefore, the variable force exerted by the stopper needs to overcome the fluid pressure force to cause the opening of the check valve at the fluid release triggering position. To the contrary, such fluid pressure force does not exist, or to a limited extent when the rocker comes back to the valve closing position. Thereby the force which the variable force F136 needs to overcome to maintain the reset valve in its open position is much smaller than the force needs to overcome to cause the opening of the reset valve. Thus, the closing of the fluid releasing valve is allowed by the stopper at a position of the rocker, which can be called the fluid release inhibiting position, which is closer to the valve closing position of the rocker than the above mentioned fluid release triggering position.

In the two following embodiment elements similar to the second embodiment have the same references and work in the same way.

Figure 9:
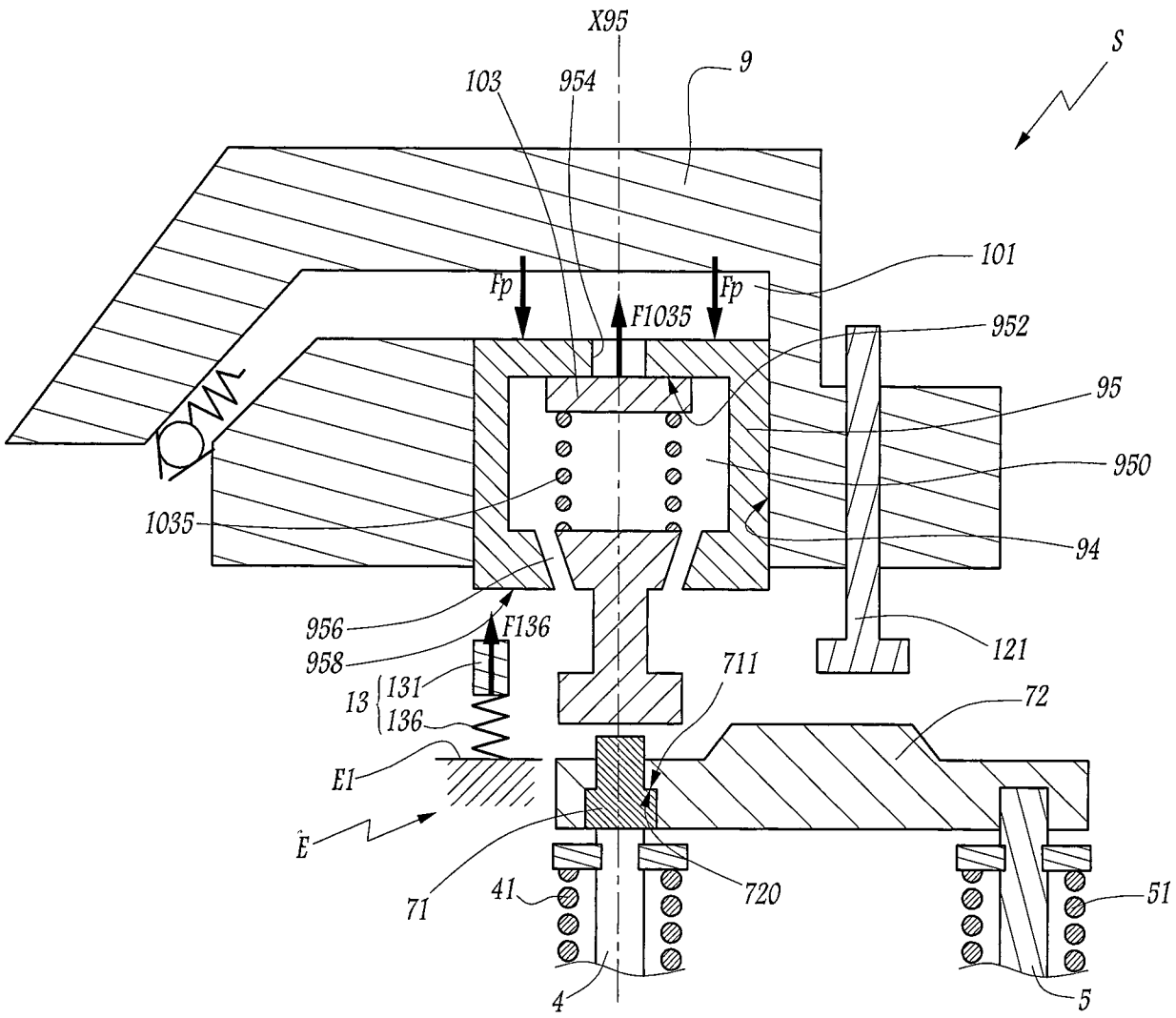
FIG. 9 is a schematic partial sectional view of a valve actuation mechanism according to a filth embodiment of the invention.

A fifth embodiment of the invention is represented on FIG. 9. In this embodiment, each rocker 9 comprises a discharge valve 103, which can be a safety valve known per se, and which, in this embodiment is carried by the piston, for example by being housed in a hollow portion 950 of piston 95 housed in bore 94. Discharge valve is a normally closed valve which is opened by the fluid pressure in the chamber 101 when such pressure exceeds a predetermined threshold to allow fluid flow out of the chamber 101. The discharge valve 103 forms the valve for releasing fluid from the chamber 101. As an example, discharge valve 103 shown on FIG. 9 is kept in sealing contact with a seat 952 of piston 95 by a compression spring 1035 exerting a force F1035. Seat 952 extends around a hole 954 which fluidly connects chamber 101 with a hollow portion 950 of piston 95. Piston 95 comprises two bleed passages 956 which fluidly connect hollow portion 950 with the outside of piston 95 and rocker 9.

In this embodiment, an elastic stopper 13 fast with a housing E1 of engine E cooperates, for example via a contact element similar to pushrod 131, with a surface 958 of piston 95. Discharge valve 103 is movable with respect to seat 952 along axis X95.

This embodiment works in the same manner as in the previous embodiments. When contact is made between pushrod 131 and surface 958, main compression spring 136 is first deformed until compression force F136 becomes superior to fluid pressure force Fp exerted by fluid in chamber 101 on piston 95. At this time, as pushrod 131 stops movement of piston 95 along axis X95, fluid pressure force Fp is then exerted on discharge valve 103 through hole 954. When fluid pressure force Fp becomes superior to compression force F1035 exerted by spring 1035 on discharge valve 103, discharge valve 103 opens. As discharge valve 103 is not anymore in sealing contact with seat 952, fluid is purged from chamber 101 to hollow portion 950 and then outside of piston 95. Thus, piston 95 can be pushed back in its first position. In this case, the exertion of force F136 permits to overcome force F1035 to open discharge valve 103, without the stopper acting, directly on the discharge valve, only due to the increase of pressure in chamber 101 created by force F136 exerted on the piston.

In a variant of this embodiment, instead of being carried by the piston, the discharge valve could be carried by the main body of the rocker, as long as it can release, fluid out of the chamber 101 when pressure in chamber 101 exceeds a certain threshold due to the force exerted by the stopper on the activation piston.

Figure 10:
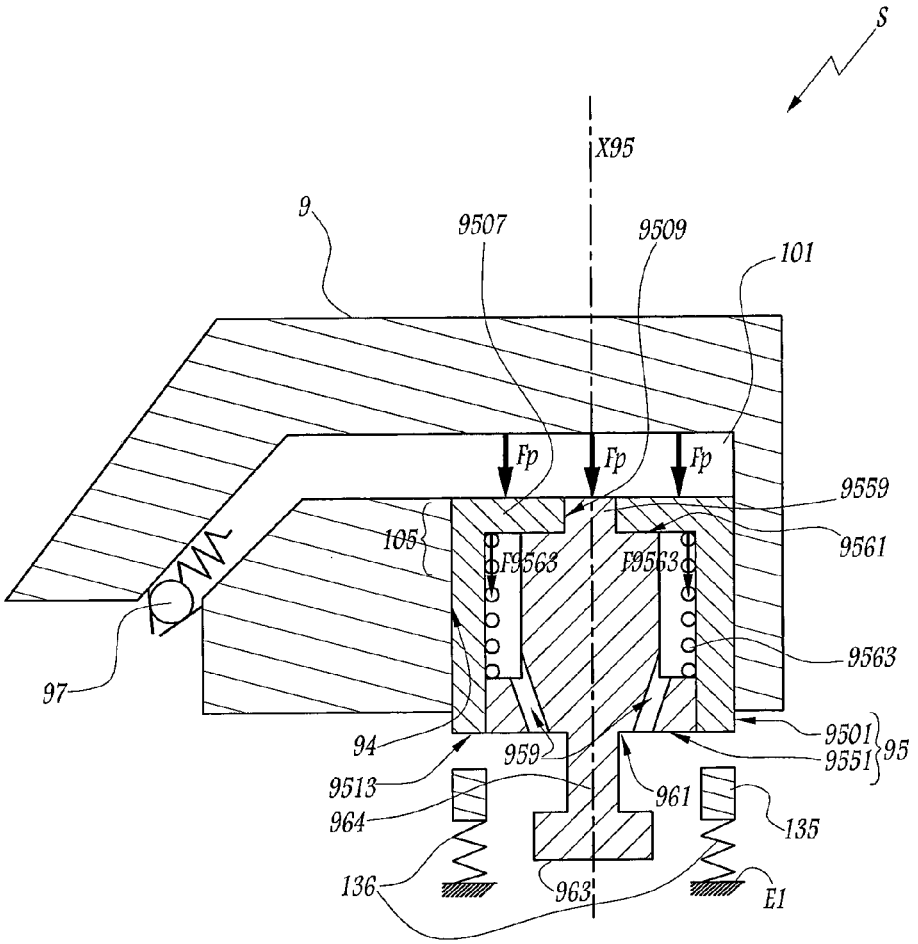
FIGS. 10 and 11 are schematic partial sectional views of a valve actuation mechanism according to a sixth embodiment of the invention, represented in two configurations
Figure 11:
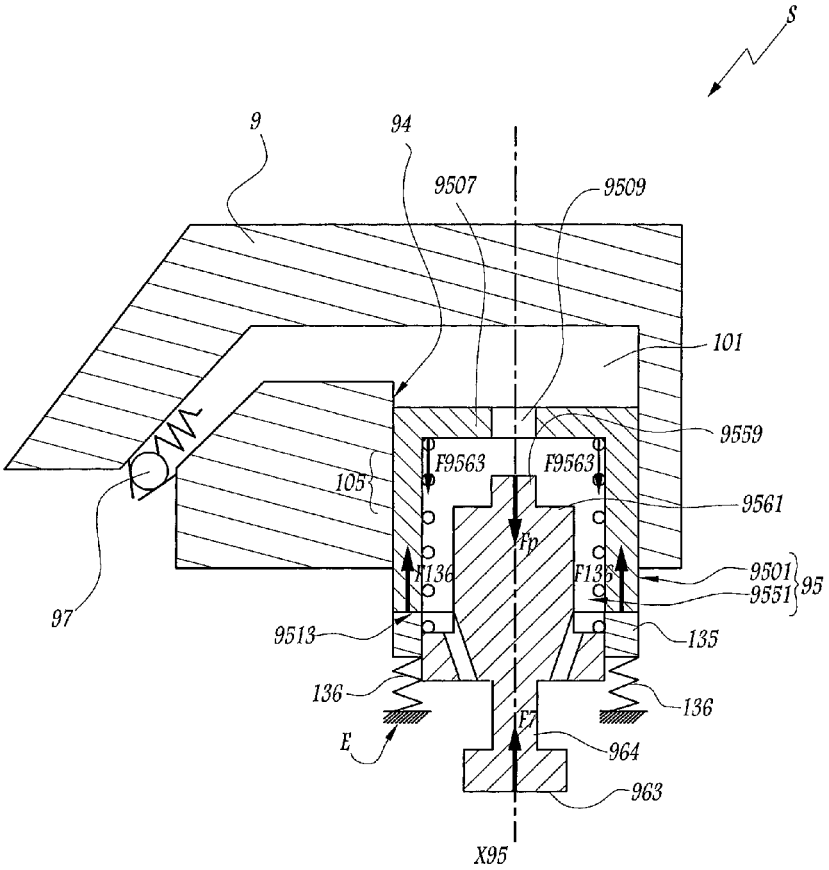

A sixth embodiment of the invention is represented on FIGS. 10 and 11 in which the exhaust valves and the valve opening actuator are not shown.

Valve actuation mechanism S also comprises a stopper 13, which comprises elastic means 136 which are stressed when the rocker travels from its valve closing position to its valve opening position. The stopper 13 may have a fork-shaped contact element 135, for example with a half-circular shape extending between two parallel fingers. The contact element 135 is connected to the engine housing E1 by elastic means which are here embodied as a compression spring 136. The part of the engine E housing E1 to which the stopper 13 is attached is preferably the cylinder head, but could be an other part rigidly connected to the cylinder head or to the crankcase.

In this embodiment, activation piston 95 comprises a first element 9501 which has a hollow portion 9502 and comprises a tubular peripheral wall 9503 parallel to axis X95. A plane circular wall 9507 extends perpendicularly to axis X95 from an end of peripheral wall 9503 on the side of piston chamber 101. Plane wall 9507 comprises a central hole 9509 aligned with axis X95. Central hole 9509 forms a fluid passageway between chamber 101 and hollow portion 9502 of first element 9501.

First element 9501 is mounted within a corresponding cylinder bore 94 created in the rocker 9 in the continuation of the chamber 101 and having the same axis X95 and first element is adapted to move in translation with respect to rocker 9 along axis X95.

Piston 95 further comprises a central member 9551 housed in hollow portion 9502 of first element 9501 and movable in translation with respect to first element 9501, and subsequently with respect to rocker 9, along axis X95. Hollow portion 9502 is defined as the inside of the tubular peripheral wall 9503. Central member 9551 comprises two bleed passages 959 adapted to let fluid flow from hollow portion 9502 of first element 9501 to the outside of rocker 9. Central member 9551 may comprise only one bleed passage 959.

Central member 9551 comprises a pin 9559 having a form corresponding to the form of central hole 9509. Pin 9559 extends from a planar annular surface 9561 adapted to come in abutment against a portion of plane wall 9507, which acts as a stop, under action of a traction force F9563 exerted by a spring 9563 arranged between first element 9501 and central member 9551. The cooperation between pin 9559 and surface 991 forms a fluid releasing valve 105.

Piston 95 has a pushing surface 963 realized on a pin 964 which extends from a surface 961 of central member 9551 for cooperation with a valve opening actuator such as valve bridge 7 or more particularly, in the case of single valve brake technology as described above, with a slider block of a valve bridge.

Contact element 135 of stopper 13 is adapted to cooperate with an annular outer edge 9513 of first element 9501, located on the outside of rocker 9, without interfering with the central member 95551.

Valve actuation^meclranism^S^orks'i h^ollo^i ^way: when rocker 9 is in a position corresponding to the closed state of valves 4 and 5, a clearance C1 separates edge 9513 from contact element 135 of stopper 13. Prior to the engine brake valve openings, piston 95 is moved to its second position thanks to a fluid pressure raise in chamber 101.

Once the two engine brake valve openings have been realized, thanks to a rotation R1 of rocker 9, a main exhaust opening of valves 4 and 5 is to be performed. Therefore, during the opening of valves 4 and 5, piston 95 must be pushed back to its first position. When rotation R1 of rocker 9 approaches its maximal angular value, contact is made between edge 9513 and fingers 136 of fork stopper 13. At this moment, the exertion of a force F136 by stopper 13 on first element 9501 begins.

The exertion of force F136 on edge 9513, which increases as the rocker travels towards its valve opening position induces a movement of first element 9501 along axis X95 with respect to central member 955 under action of fluid pressure force Fp exerted on pin 9559.

Planar annular surface 9561 therefore becomes remote from plane wall 9507, as shown on FIG. 4, causing fluid releasing valve 105 to open and provoking fluid flow inside hollow portion 9502 of first element 9501. Fluid is purged outside rocker 9 via bleed passages 959 which are realized in base portion 9557 of central member 9551. Central member 9551 is moved towards chamber 101 under action of spring 9563, until a contact is made again between surface 9561 and wall 9507. Piston 95 as a whole is then pushed in its first position under action of valve opening actuator, which exerts a force F7 on central member 9551 induced by the springs which return the exhaust valves to their closed positions.

In other words, during a movement of the rocker 9 towards the opening of the valves 4 and 5 corresponding to a main exhaust event, the stopper will progressively block the movement of first element 9501 with respect to the engine casing. Due to the fact that the rocker continues its movement towards the valve bridge 7, the pressure in the main chamber, acting on the pin 9559 causes the central member 9551 to continue the movement in the direction of the valve bridge. Therefore, there is a tendency for the central member 9551 and the first element 9501 to separate, and when the pin 9559 escapes of hole 9509, the control fluid contained in chamber 101 can be discharged though the central hole 9509 and then through bleed passages 959.

In a non-represented embodiment of the invention, applicable to all those embodiments having elastic means, the elastic means can be realized with a variable stiffness. This can be done by providing a variable pitch between the coils of a compression spring 136. The pitch between the coils of compression spring 136 is determined so that the force increase needed to overcome the force which keeps check valve 97, reset valve 99 or discharge valve 103 in closed position is obtained with no point of inflexion, in order to reduce the force variations exerted on the various parts of valve actuation mechanism S and particularly on the valves. For example, in the embodiment of FIGS. 1 to 4, compression spring 136 can have a relatively low pitch between its coils in the vicinity of pushrod 131, and an increasing pitch towards end 1342, so that the deformation of compression spring 136 induces an increase of compression force F136 according to a parabolic profile.

According to a non-shown embodiment of the invention valve actuation mechanism S may apply to a single exhaust valve system, in which each rocker is adapted to move only one valve. In this case, the valve actuation mechanism does not comprise any bridge, the single valve being moved via an intermediate part adapted to cooperate with piston 95.

According, to a non-shown embodiment, piston 95 is adapted to exert valve opening effort F9 on the whole of valve bridge 7. Both valves 4 and 5 are connected to valve bridge 7 so that they are opened or closed simultaneously.

In all the above embodiments, the position of the stopper with respect to the engine housing can be set so that it interferes with the relevant member of the rocker at a given position of the rocker between its valve closing, and valve opening positions. Therefore, the position of the stopper with respect to the housing and with respect to the rocker is one of the parameters which defines the fluid release triggering position of the rocker, which should correspond to the timing at which the activation piston has to be moved from its second position to its first position in the valve opening and closing cycle. The position of the stopper can be made adjustable for fine-tuning of the timing at which the activation piston is effectively moved from its second position to its first position.

Also, in case the stopper comprises elastic means, such means can take various forms. In the example shown, a compression spring is used and is stressed in compression when the rocker travels from the valve closing position to the valve opening position of the rocker. But other types of springs could be used, such as tension springs or torsion springs, which are then to be stressed respectively in traction or in torsion when the rocker travels from the valve closing position to the valve opening position of the rocker Fine tuning of the fluid release triggering position and/or of the fluid release inhibiting position can be altered by providing some adjustability of the pre-stressing of the elastic means.

The technical features of the various embodiments and variants described here above can be combined in the scope of the invention. Particularly, the features of the embodiments of FIGS. 5 and 6 may apply to the embodiments of FIGS. 7 to 11.

The invention claimed is:

1. Valve actuation mechanism for an internal combustion engine on an automotive vehicle, comprising rockers moved by a camshaft, each rocker being adapted to exert a valve opening force on at least a portion of a opening actuator of each cylinder, via an activation piston of the rocker movable with respect to the rocker under action of a fluid pressure raise in a chamber, from a first position to a second position, in which a cam follower of the rocker is adapted to read at least one auxiliary valve lift sector of a cam of the camshaft so as to perform an engine operating function, each rocker comprising a valve for releasing fluid from the chamber, wherein the valve actuation mechanism comprises, for each rocker, a stopper fast with a housing of the engine and adapted to exert, on a member of the rocker, a variable force for opening the fluid releasing valve, wherein the stopper comprises elastic means which are stressed when the rocker travels from its valve closing position to its valve opening position.

2. Valve actuation mechanism according to claim 1, wherein the variable force increases when the rocker rotates from a valve closing position to its valve opening position.

3. Valve actuation mechanism according to claim 1, wherein the stopper causes opening of the fluid releasing valve for a first position of the rocker and allows closing of the fluid releasing valve for a second position of the rocker, said second position being closer to the valve closing position of the rocker than said first position.

4. Valve actuation mechanism according to claim 1, wherein the stopper comprises a spring adapted, when deformed, to exert a compression force on said member.

5. Valve actuation mechanism according to claim 4, wherein the stopper comprises a mobile contact element biased by the spring and adapted to cooperate with said member, the contact element and the spring are movable in translation with respect to a jacket in which the contact element and the main spring are housed, said jacket being fast with said engine housing.

6. Valve actuation mechanism according to claim 5, wherein the jacket comprises a stop element against which the contact element comes in abutment when the piston has to be moved from its second position to its first position.

7. Valve actuation mechanism according to claim 1, wherein the elastic means of the stopper have a variable stiffness.

8. Valve actuation mechanism according to claim 1, wherein the stopper comprises a main spring and an auxiliary spring, wherein, during a first portion of the rocker travel from a valve closing to a valve opining position, only the auxiliary spring is stressed, and wherein during a second portion of the rocker travel, the main spring is stressed.

9. Valve actuation mechanism according to claim 1, wherein the stopper is in permanent contact with the member of the rocker on which the force of the stopper is exerted.

10. Valve actuation mechanism according to claim 1, wherein prior to the exertion of the force of the stopper on the member of the rocker, the stopper is remote from the member by a clearance.

11. Valve actuation mechanism according to claim 1, wherein the force exerted by the stopper on said member is adapted to overcome a force keeping said valve in a closed position only when the piston has to be moved from its second position to its first position.

12. Valve actuation mechanism according to claim 1, wherein for each rocker, the member on which the force of the stopper is exerted cooperates with a check valve adapted to allow fluid flow from a fluid feeding circuit of the rocker to the chamber or to block fluid flow from the chamber to the fluid feeding circuit, the check valve forming the valve for releasing fluid from the chamber.

13. Valve actuation mechanism according to claim 1, wherein for each rocker, the member on which the force of the stopper is exerted cooperates with a reset valve, movable with respect to the rocker, between a first position, in which it blocks fluid flow between the chamber and the outside of the rocker, and a second position, in which it allows fluid flow between the chamber and the outside of the rocker, said reset valve forming the valve for releasing fluid from the chamber.

14. Valve actuation mechanism according to claim 1, wherein the fluid releasing valve is adapted to allow fluid flow from the chamber to the outside of the rocker, wherein the piston comprises a first element housed in the bore (94) and movable in translation with respect to the rocker, and a central member housed in a portion of the first element and movable in translation with respect to the first element along a longitudinal axis of the piston, wherein the fluid releasing valve is formed by a cooperation between the first element and the central member, and wherein the force of the stopper is exerted on the first element.

15. Valve actuation mechanism according to claim 1, wherein the valve for releasing fluid from the chamber is kept in its closed position by a fluid pressure force in a chamber fluidly connected to the piston chamber.

16. Valve actuation mechanism according to claim 1, wherein each rocker comprises a normally closed discharge valve which is opened by the fluid pressure in the chamber when such pressure exceeds a predetermined threshold to allow fluid flow out of the chamber, said discharge valve forming the valve for releasing fluid from the chamber, and wherein the member on which the force of the stopper is exerted is the piston.

17. Valve actuation mechanism according to claim 16, wherein the discharge valve is carried by the piston.

18. Valve actuation mechanism according to claim 1, wherein the valve for reducing fluid pressure in the chamber is biased towards its closed position by a spring.

19. Valve actuation mechanism according to claim 1, wherein it is one of:

an exhaust valve actuation mechanism:

wherein the activation piston activates an exhaust gases recirculation function when it is in its second position; or wherein the activation piston activates an engine brake function when it is in its second position; or an intake valve actuation mechanism.

20. An automotive vehicle comprising valve actuation mechanism valve actuation mechanism according to claim 1.

* * * * *